US005355709A

United States Patent [19]

Bauder et al.

[11] Patent Number: 5,355,709

[45] Date of Patent: Oct. 18, 1994

[54] METHODS AND APPARATUS FOR EXPANSION REFORMING THE BOTTOM PROFILE OF A DRAWN AND IRONED CONTAINER

[75] Inventors: Joseph Bauder, Huntingdon Valley; George Ruff, Cornwells Heights, both of Pa.

[73] Assignee: Crown Cork & Seal Company, Philadelphia, Pa.

[21] Appl. No.: 976,138

[22] Filed: Nov. 10, 1992

[51] Int. Cl.[5] ..... B21D 51/26

[52] U.S. Cl. ..... 72/356; 72/379.4; 72/393

[58] Field of Search ..... 72/353.4, 393, 379.4, 72/356; 413/69

[56] References Cited

U.S. PATENT DOCUMENTS

| | | | |
|---|---|---|---|
| 1,524,106 | 1/1925 | Riegel | 72/393 |
| 2,158,312 | 5/1939 | Terrell | 72/353.4 |
| 2,654,413 | 10/1953 | Weidel | 72/393 |
| 2,943,667 | 7/1960 | Ewing et al. | 72/393 |
| 3,382,699 | 5/1968 | Seeman | 72/353.4 |
| 3,687,098 | 8/1972 | Maytag | 113/120 R |
| 3,696,657 | 10/1972 | Maytag | 72/450 |
| 3,759,142 | 9/1973 | Maytag | 91/396 |
| 3,808,868 | 5/1974 | Wolfe | 72/353 |
| 3,951,083 | 4/1976 | Hortig | 113/7 A |
| 3,964,413 | 6/1976 | Saunders | 113/120 AA |
| 4,070,888 | 1/1978 | Gombas | 72/91 |
| 4,446,714 | 5/1984 | Cvacho | 72/370 |
| 4,519,232 | 5/1985 | Traczyk et al. | 72/133 |
| 4,599,123 | 7/1986 | Christensson | 156/69 |
| 4,620,434 | 11/1986 | Pulciano et al. | 72/347 |
| 4,685,582 | 8/1987 | Pulciani et al. | 220/66 |
| 4,693,108 | 9/1987 | Traczyk et al. | 72/370 |
| 4,723,430 | 2/1988 | Hahn | 72/54 |
| 4,732,027 | 3/1988 | Traczyk et al. | 72/133 |
| 4,768,672 | 9/1988 | Pulciani et al. | 220/66 |
| 4,774,839 | 10/1988 | Caleffi et al. | 72/354 |
| 4,834,256 | 5/1989 | McMillin | 220/66 |
| 4,919,294 | 4/1990 | Kawamoto et al. | 220/70 |
| 4,953,738 | 9/1990 | Stirbis | 220/606 |
| 5,040,682 | 8/1991 | Palisin, Jr. et al. | 206/519 |
| 5,105,973 | 4/1992 | Jentzsch et al. | 220/606 |
| 5,222,385 | 6/1993 | Halasz et al. | 72/393 |

FOREIGN PATENT DOCUMENTS

| | | |
|---|---|---|
| 85992/91 | 10/1991 | Australia . |
| 482581A1 | 4/1992 | European Pat. Off. . |

*Primary Examiner*—Lowell A. Larson
*Attorney, Agent, or Firm*—Woodcock, Washburn, Kurtz, Mackiewicz & Norris

[57] ABSTRACT

Methods and apparatus for reforming drawn and ironed containers are disclosed. The invention permits improvements in bottom profiles by radially expanding arcuate segments against the inner leg that connects the bottom rim of the container to the center panel. The reforming introduced by the present invention permits containers to be constructed of a lighter gauge material without suffering from any loss in strength. The container being reformed is seated on a flat surface and a radially expanding die is used in conjunction with a tapered mandrel to reform the bottom profile. Most preferably, the reforming tool of the present invention is incorporated into a container necking mechanism.

11 Claims, 5 Drawing Sheets

METHODS AND APPARATUS FOR EXPANSION REFORMING THE BOTTOM PROFILE OF A DRAWN AND IRONED CONTAINER

The present invention relates to beverage containers, and more particularly to improvements in reforming the bottoms of drawn and ironed beverage containers to provide improved performance.

BACKGROUND OF THE INVENTION

The production of beverage containers such as those used for carbonated beverages ia a highly refined art. Numerous improvements have been made to reduce weight while providing satisfactory performance. A major advance was the introduction of the two piece system, wherein a top lid or closure is joined to a portion that includes both the container sidewall and the container bottom. This latter portion is typically drawn and ironed from a single piece of aluminum or steel to create a thin-walled container with a bottom structurally capable of withstanding the pressures and stresses produced by the carbonated contents.

It has been found that seemingly minor changes in the geometry of the bottom profile of a drawn and ironed container permit a less metal to be used while still maintaining acceptable performance. For example, it has been found that an upwardly domed configuration for the center panel of a bottom profile provides improved results. U.S. Pat. Nos. 4,685,582 and 4,768,672 to Pulciani et al. are directed to improved domed bottom profiles. These patents represent the current state of the art profile. U.S. Pat. No. 4,620,434—Pulciano et al. also discloses upwardly domed bottom profiles that resist dome reversal and teaches that the dome should not be made too shallow or it will fail by reversing. This type of failure is related to the forces generated by the internal pressures of the carbonated contents of the container and is typically referred to as the "static dome reversal pressure," i.e., the maximum pressure below which the container will not fail.

Several attempts have been made to optimize static dome reversal pressure in upwardly domed bottom configurations. For example, U.S. Pat. No. 4,834,256—McMillin teaches that it is possible to make shallower domes that exhibit acceptable resistance to reversal under static pressure conditions. Also, U.S. Pat. No. 4,953,738—Stirbis et al. teaches that the strength of a domed container bottom may be improved by adding grooves and ribs. This patent discusses the problem that arises when configuring domes because, although deeper domes are stronger, they reduce the useful volume of the container, requiring a taller container that is more susceptible to sidewall buckling. Finally, U.S. Pat. No. 4,919,294—Kawamoto et al. discloses non-spherical domes based upon a catenary curve profile. This patent includes data comparing the disclosed catenary domes with the prior art to show improvements in "pressure proofness" which apparently relates to static resistance to dome reversal.

In addition to the load placed in the container bottom by static pressure generated by the contents, it has been found that the forced generated during handling also may cause a filled container to fail. It has therefore been suggested that container be made more "drop resistant." For example, U.S. Pat. No. 5,105,973—Jentzsch et al. discloses bottom profiles that purportedly exhibit improved drop resistance. This patent teaches that although it is known to decrease dome diameter and increase panel height to attain improved drop resistance, it is preferable to use a profile having an annular supporting portion formed between the dome and the inner leg of the chime over at least part of this circumference.

Clearly, the variations in the geometry of bottom profiles are almost limitless. Nevertheless, despite the novel geometries known in the prior art, significant challenges arise when certain geometries are produced on the massive scale of commercial beverage container construction. Additionally, the complexities of the bottom forming machinery typically employed has hindered the introduction of improved bottom profiles.

Those of skill in the metal container forming arts are well aware of the various techniques by which a blank is drawn and ironed into a thin sidewall container that has an integral bottom profile. Moreover, it is well known to perform secondary operations to add additional features to the drawn and ironed container. For example, a necking operation may be used to create a particular profile at the open end of the container in order to provide the proper size and shape for engaging a closure or container lid. Apparatus for performing such necking operations is disclosed in U.S. Pat. No. 3,687,098—Maytag. The technology described in this patent is used commercially in Bellvac can necking apparatus Models 210, 575 and 595, available from Bellvac Production Machinery (USA). The Maytag patent discloses that a neck of reduced diameter is formed by axially moving an unformed container into a stationary necking die. The cooperation between the surfaces of the necking die and a punch that slides inside the container results in the desired deformation. A variation of this system is disclosed in U.S. Pat. No. 4,723,430—Hahn. By including axially deformable members in a mandrel, other profiles are be introduced into the can end. As shown in the Hahn patent, the shape of the deformable members is chosen so that when compressed, they expand radially outwardly to form a full circle. A similar technique is shown in U.S. Pat. No. 4,599,123—Christensson for flaring the open end of a container/lid assembly during welding.

Certain improvements have been made with reference to bottom reforming equipment as well. For example, EPO Publication No. 482 581 A1 discloses apparatus for making bottom profiles such as those disclosed in the Jentzsch et al. patent referenced above. The apparatus uses either a roller or a swaging tool that reforms the inner leg. The roller apparatus is disclosed in several embodiments that are moved circumferentially around the inner wall. In the case of the swaging tool, a portion of the tool moves transversely and is urged into the sidewall, deforming it. In order to locate the bottom profile of a container with relation to the reforming tooling, both embodiments use specially formed housing that has a mating profile machined thereon.

Despite the improvements made in bottom profile geometry and in container forming equipment, a need still remains for methods and apparatus that will permit bottom profile forming/reforming in a reliable manner suitable for high volume production. It is therefore an object of this invention to provide improved bottom profile reforming techniques that permit a wide variety of bottom profiles to be implemented. A further object of the present invention is to provide such improved techniques in the form of modifications to existing container forming equipment. This latter object permits improvements to be readily incorporated into existing production lines using machinery known to be reliable and which is familiar to its operators.

SUMMARY OF THE INVENTION

The present invention provides apparatus for reforming a container using a tool having a base portion that comprises a substantially flat contacting surface for receiving the support surface of a container and a plurality of radially expandable elements arrayed about a central axis. The actual deformation is controlled by a means for displacing one or more of the elements outwardly and away from the central axis to deform a portion of a container seated on the flat surface of the base portion. In a preferred embodiment, the radially expandable elements comprise deforming portions having a arcuate deforming surface corresponding to a predetermined portion of the container to be deformed. In certain preferred embodiments, however, the arcuate deforming surfaces of the plurality of radially expandable elements form a substantially continuous circumferential surface. The radially expandable element may have either a round profile, a square profile or a substantially square profile having one or two chamfered edges. In a most preferred embodiment the tool is adapted to receive a tapered mandrel, and engagement of the tapered mandrel with the tool displaces the radially expandable elements outwardly and away from the central axis.

The present invention also discloses methods of reforming a container, comprising the steps of placing the container in a reforming tool comprising positioning it on a flat contacting surface in alignment with one or more radially expandable segments, and expanding the segments to deform at least a portion of the container. The segments are then retracted and the container is removed. In a most preferred embodiment the expansion of the segments comprises the step of inserting a tapered mandrel into the reforming tool.

Finally, the present invention also discloses drawn and ironed beverage containers having substantially cylindrical sidewalls and a bottom profile comprising an arcuate bottom rim defining a support surface, an upwardly domed center panel, and an inner leg connecting the bottom rim and the center panel, wherein support surface is positioned against a flat contacting surface and the inner leg is reformed by expanding one or more radially expandable die portions against the inner leg to cause its outward deflection.

DETAILED DESCRIPTION OF THE PREFERRED EMBODIMENT

Figure 1A:
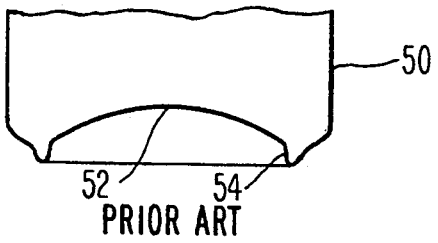
FIGS. 1A–1B are, respectively, a cross-sectional and a bottom view of a typical prior art domed bottom profile.
Figure 2A:
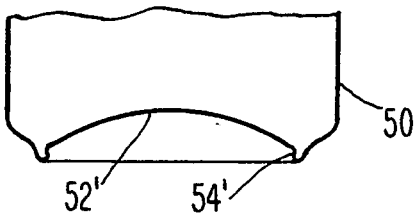
FIGS. 2A–2B are, respectively, a cross-sectional and a bottom view of a typical domed bottom profile that has been reformed in accordance with the present invention.
Figure 1B:
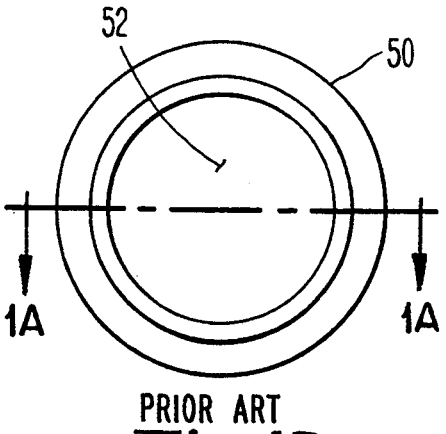
Figure 2B:
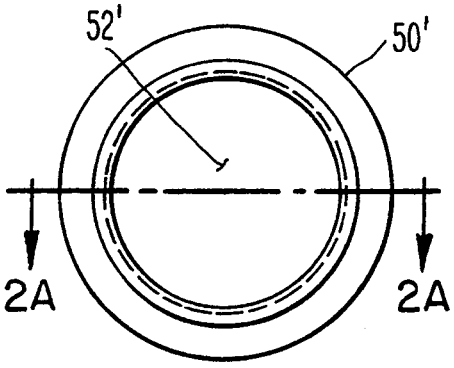
Figure 3:
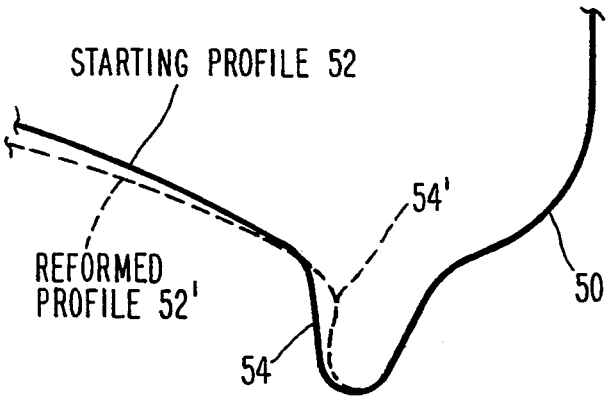
FIG. 3 is an enlarged, partially broken away view, of the reformed bottom profile illustrated in FIG. 2A.
Figure 2C:
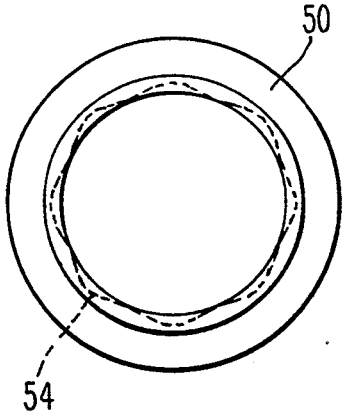
FIG. 2C is a bottom view of an alternate embodiment of the reformed bottom profile shown in FIGS. 1A–1B.

FIGS. 1A–1B illustrate a typical bottom profile of a drawn and ironed beverage container 50. As explained above, profiles similar to the one illustrated are well known in the art. The bottom profile defines a support surface 56 upon which the container rests. The bottom profile also defines a radius of curvature of an upwardly domed center panel 52 and an inner wall of the bottom leg 54 that is a predetermined height above the support surface 56. In accordance with certain aspects of the present invention, the bottom profile shown in FIGS. 1A–1B, or any other substantially similar bottom profile is reformed as shown in FIGS. 2A–2B. The details of the reforming are more clearly seen in the enlarged view of FIG. 3. As illustrated, the radius of curvature of the reformed center panel 52' is somewhat greater than the original panel 52, i.e., the dome is shallower. Additionally, the original inner leg 54 is reformed to introduce a pronounced bend in the reformed profile 54'. These two features cooperate and compliment one another such that the resulting reformed bottom is stronger than the prior art bottom, and thus results in a container of equal strength that is made of a thinner gauge material than the predecessor designs, thereby saving weight. In particular, the design disclosed herein is more "drop resistant," i.e., it better resists the forces created when a filled, pressurized container is dropped. As explained below, in certain embodiments as illustrated in FIG. 2C, it is desirable to create a reformed leg profile 54' only in certain predetermined portions of the circumference of the bottom of the container 50, while leaving other portions in their original condition, the "starting profile" shown in FIG. 3.

Figure 4A:
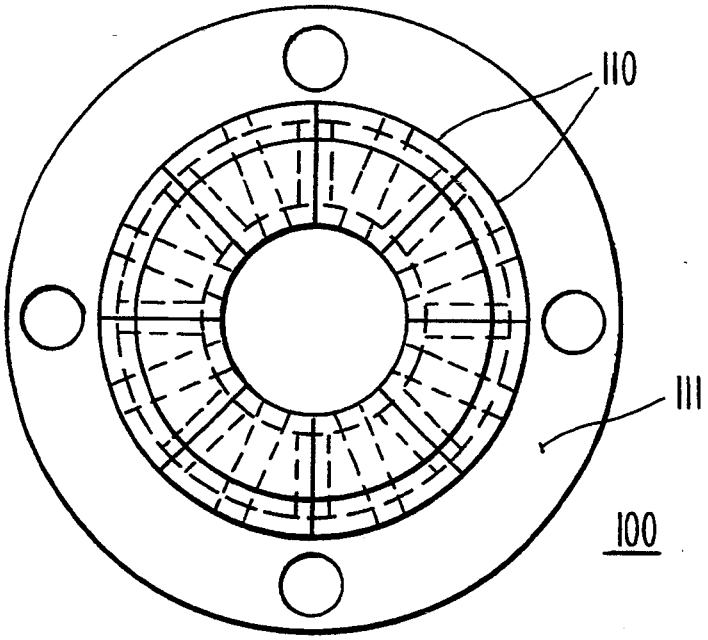
FIGS. 4A–4B are, respectively, bottom and elevation views of an embodiment of an apparatus for reforming bottom profiles made in accordance with the present invention.
Figure 4B:
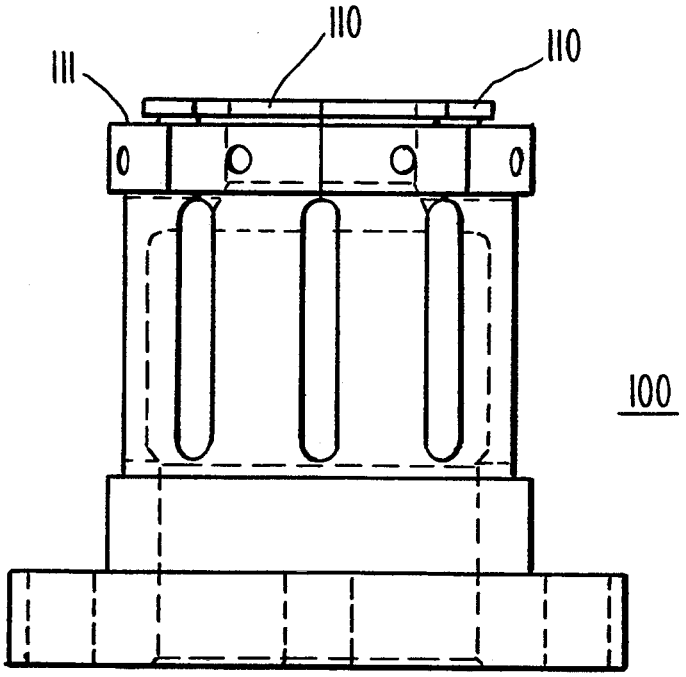

Referring now to FIGS. 4A–4B, there is shown a preferred embodiment of a reforming tool 100 made in accordance with the present invention. The tool 100 is comprised of a collet-type assembly of a plurality of radially expandable arcuate segments 110 arranged around a central axis. Most preferably, this tool is a one piece assembly, that is, the arcuate segments are integral with the rest of the collet assembly. In the instance of reforming a bottom profile in accordance with FIG. 2B, it will be understood that the radially expandable arcuate segments 110 will be designed to deform substantially the entire circumference of the inner leg in one or more expansions. In other words, if the entire circumference is not reformed in one operation, portions may be reformed, and the tool 100 or container will be rotated relative to one another so that the remaining portions may be reformed during a second expansion of the tool 100. Alternatively, to create the profile illustrated in FIG. 2C, the radially expandable arcuate segments 110 will be chosen so as to contact and deform only predetermined portions of the circumference in a single expansion. Another aspect of the tooling 100 shown in FIGS. 4A–4B is the provision of a substantially flat container contacting surface 111. As explained in further detail below, the flat contacting surface 111 provides a constant and controlled distance between to the reforming portions of the expandable arcuate segments 110, resulting in a reliable, repeatable and accurate positioning system that is tolerant of the variations between containers. Those of ordinary skill will appreciate that repeatability of the reforming methods and apparatus disclosed herein is critical to container performance, and is accomplished in the present invention by locating on the annular supporting surface 56 (base diameter) of the container 50. This achieves accurate placement of the reformed profile 54' while maintaining alignment and self-centering of the container to the reforming tool 100, thus alleviating the requirement for nesting on the bevel (outside profile) portion of the container 50, as was done in the prior art.

Figure 5A:
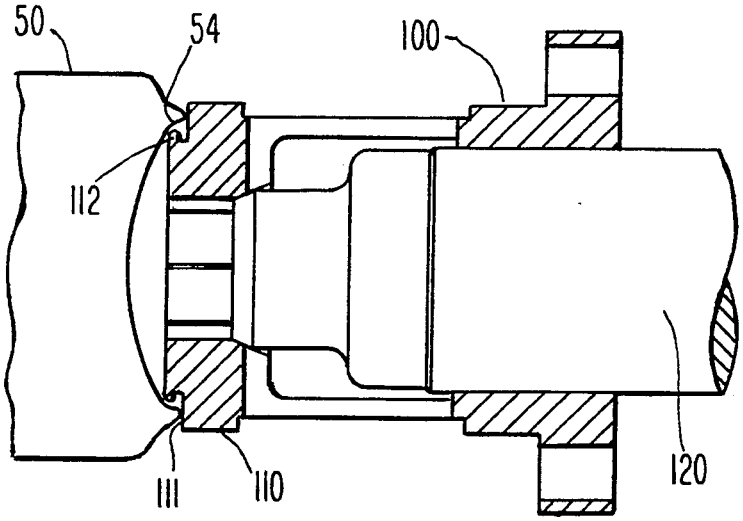
FIGS. 5A–5C are a sequence of partial cross-sectional views of the apparatus depicted in FIGS. 4A–4B being used to reform the bottom profile of a container.
Figure 5B:
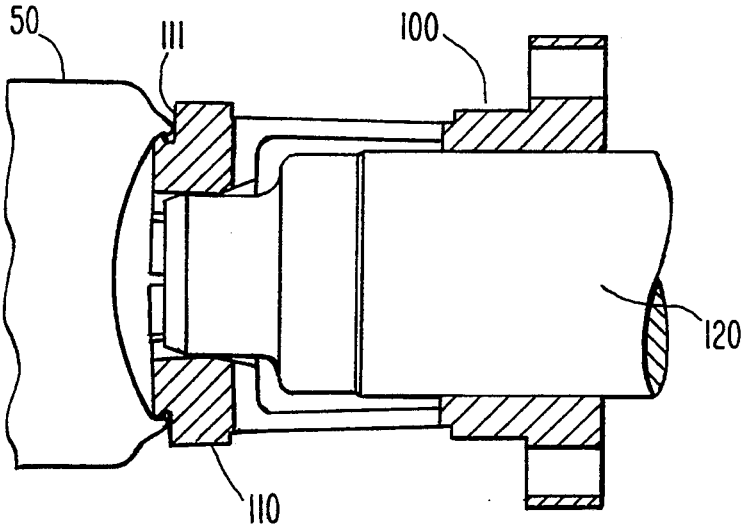
Figure 5C:
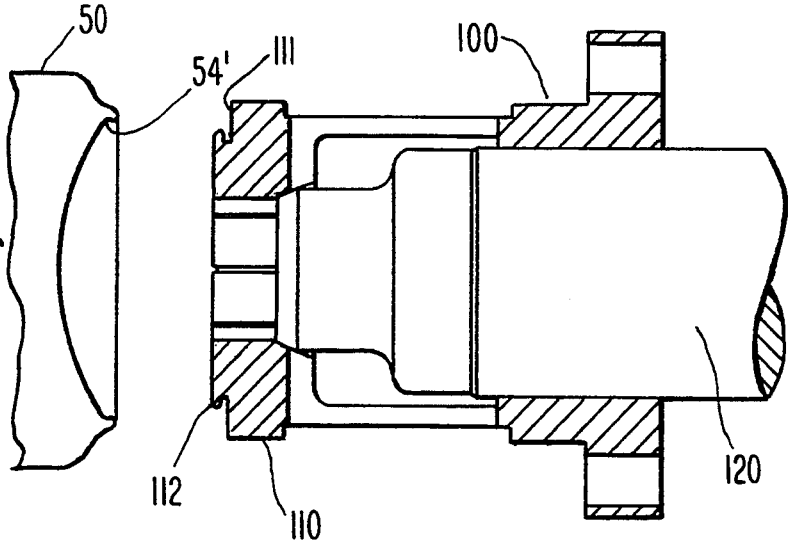

Further details of the operation of the present invention are illustrated in the sequence of views shown in FIGS. 5A–5C. Initially, referring to FIG. 5A, the bottom of a container 50 is brought into contact with and into alignment with the radially expandable arcuate segments 110 of the reforming tool 100 described above such that a deforming portions 112 of the tool 100 are in contact or at least close proximity with at least some portions of the inner leg 54. As mentioned above, the reforming tool 100 of the present invention provides a substantially flat contacting surface 111 upon which the container rests. Since the support surface 56 of the container 50 is a known reference datum, the distance upward along the inner leg from this datum is a repeatable dimension. Therefore, if the container 50 is properly and fully seated on the contacting surface 111, since the distance between the surface 111 and the deforming portions 112 is known, the inner leg will be deformed in an accurate, repeatable and reliable manner.

As explained above, the beverage containers referred to herein are highly engineered articles of manufacture that are constructed within tolerances on the order of one thousandth of an inch or less. Those of ordinary skill will readily appreciate the tremendous advantage of the container seating system disclosed herein, since it has been found that if the deformed portion of the inner leg is not precisely placed and controlled, the static dome reversal pressure and drop resistance of the container will be adversely affected.

Referring now to FIG. 5B, after the container is properly seated on the flat contacting surface 111 of the reforming tool 100, a mandrel 120 is inserted into the tool 100 to cause the expansion of the deforming portions 112 of the tool 100. The radial expansion of the deforming portions 112 causes the reforming of the inner wall 54, which is unsupported and therefore is easily deformed in the direction shown. The simplicity of the present invention permits precise controlled expansion and thus, results in precise deformation of the container. During this step of the reforming operation, in certain embodiments of the present invention, it may also be preferable to reform the diameter of the dome 52 if necessary. However, such reforming may also take place in a separate reforming operation using a doming die, or may not need to be undertaken at all if the container dome dimension is initially adjusted to result in the correct dimension after reforming.

Finally, as shown in FIG. 5C, after the container 50 has been reformed, the radially expandable elements of the reforming tool are retracted so that the container may be removed.

As will be readily appreciated by those of ordinary skill, numerous other means other than the mandrel 120 shown may be implemented to effect the radial expansion of the radially expandable arcuate segments 110 of the reforming tool 100. For example, hydraulic actuators, screw-driven elements or gear driven members could all replace the tapered collet/mandrel combination illustrated in FIGS. 5A–5C. The preferred embodiment illustrated, however, takes advantage of the axial motion found on conventional container forming machinery, such as neck forming machines. As explained in further detail below, the present invention may be retrofit into existing machinery. Additionally, it will also be appreciated that the tooling described above presents a simple, reliable and robust system that is inexpensively constructed and has very few moving parts. Moreover, the tooling disclosed herein, in addition to minimizing moving parts, also minimized contact with the container. These attributes minimize the wear of the tooling and increase the reliability of the apparatus, an important consideration for a body maker producing tens of millions of containers. The minimized contact with the container also reduced the potential for damage due to inadvertent or misaligned contact between the tooling and the container. These advantages of the present invention, i.e., the simplicity of the design, are ideally suited for high speed equipment.

Figure 6A:
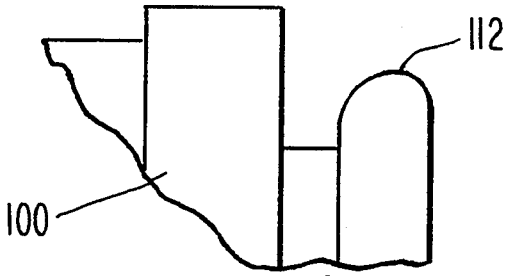
FIGS. 6A–6D are fragmentary views illustrating alternate embodiments of the reforming portion of the apparatus depicted in FIGS. 4A–4B.
Figure 6B:
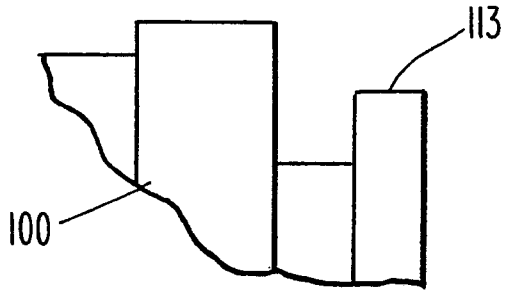
Figure 6C:
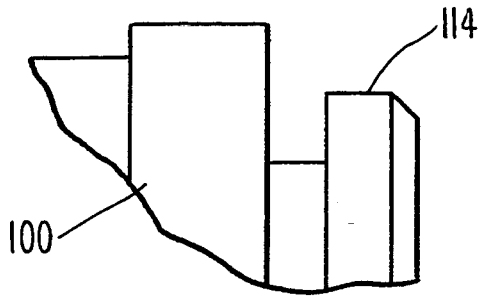
Figure 6D:
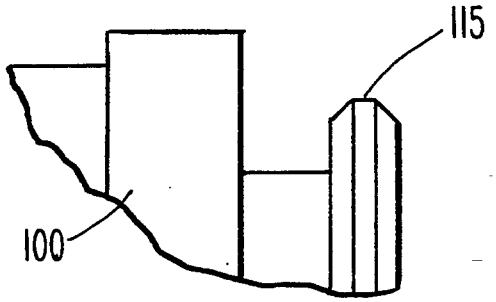

The preferred embodiments of the apparatus described above may also be modified with regard to the profile of the reformed portion of the inner wall 52 by varying the profile of the deforming portion 112 of the reforming tool 100. Examples of such modifications are illustrated in the fragmentary views of FIGS. 6A–6D. As shown, the deforming portion 112 may be of nearly any shape. The embodiment shown and described above is illustrated in FIG. 6A. This round shape 112 may be replaced by a square profile 113 shown in FIG. 6B or by the single or double chamfered profiles illustrated in FIGS. 6C–6D, respectively.

The present invention also discloses methods of reforming a container, comprising the steps of placing the container in a reforming tool comprising one or more radially expandable segments, and expanding the segments to deform at least a portion of the container. The segments are then retracted and the container is removed. In a most preferred embodiment the expansion of the segments comprises the step of inserting a tapered mandrel into the reforming tool.

Using the methods and apparatus of the present invention, improved drawn and ironed beverage containers having substantially cylindrical sidewalls and a bottom profile comprising an arcuate bottom rim, an upwardly domed center panel and an inner leg connecting the bottom rim and the center panel are disclosed. In accordance with the methods and apparatus disclosed herein the inner leg is reformed by expanding one or more radially expandable die portions against the it to cause its outward deflection.

Most preferably, the apparatus of the present invention is incorporated or retrofitted into a container necking mechanism such as that shown and described in U.S. Pat. No. 3,687,098—Maytag, which is incorporated by reference as if fully set forth herein. The mechanism shown is generally known as a "die necker." As shown in FIG. 1 of the Maytag patent, a container necking mechanism includes a necking push plate 30. In a preferred embodiment of the present invention, the necking push plate 30 is replaced by the reforming tool 100 described above. The flat contacting surface 112 of the present invention is Well suited for performing the function of the necking push plate within the necking operation, while at the same time, the radially expandable arcuate segments 110 and mandrel 120 are incorporated into the structure of the container necking mechanism. Those of ordinary skill will,realize, however, that the reforming tool 100 described herein may be readily incorporated into any of the various types of necking mechanisms known in the art, such as the apparatus known as a "spin necker," described in EPO Publication No. 482 581 A1 or into other pieces of container production equipment.

Figures 7A, 7B, 7C, 7D:
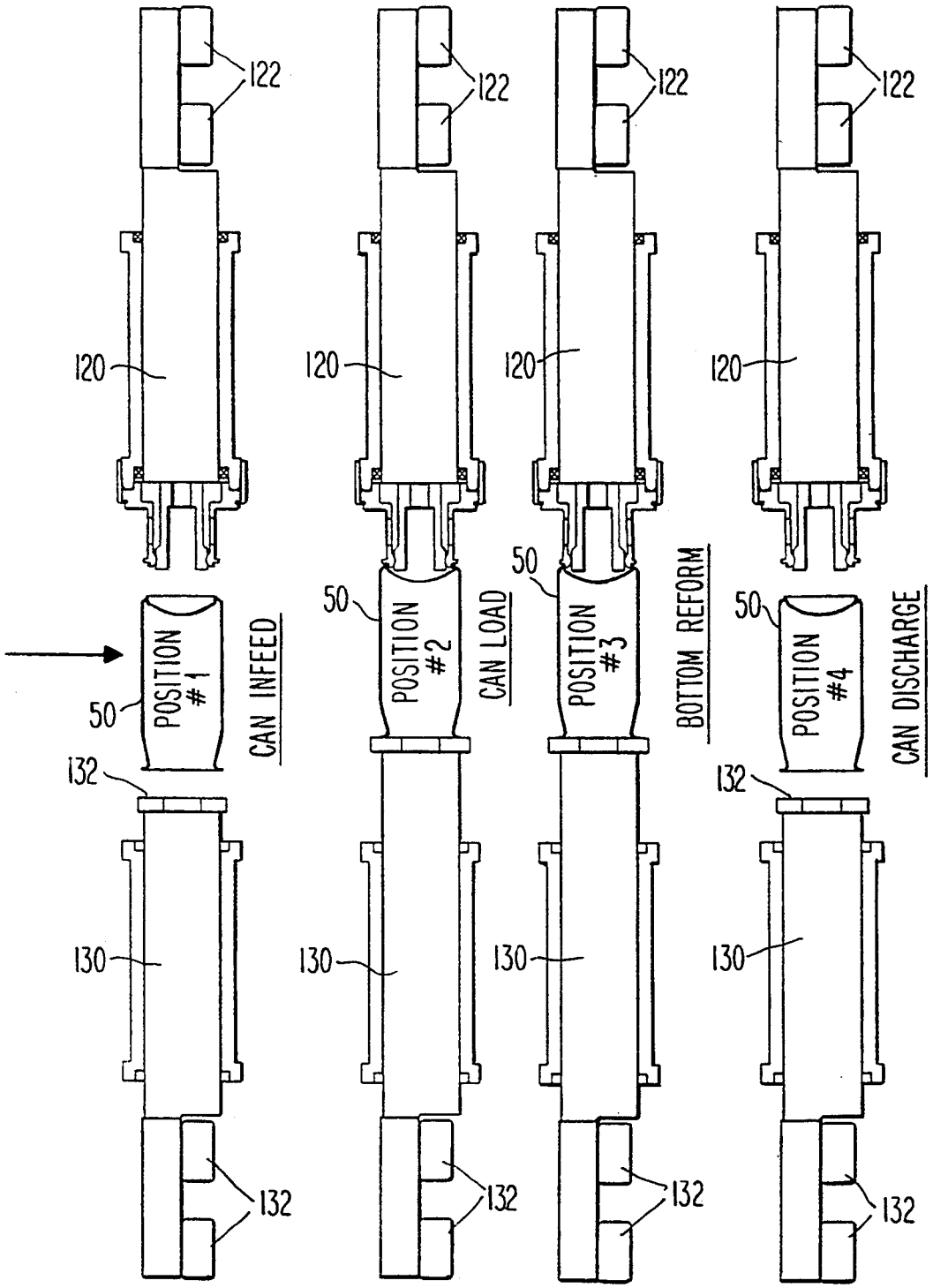
FIG 7A–7D illustrate portions of container processing equipment into which the present invention has been incorporated.

Referring now to FIGS. 7A–7D partial elevation views of container processing equipment such as the die necker discussed above are shown. FIGS. 7A–7D illustrate four "stations" or stages through which the container 50 being processed passes. In a first stage, illustrated in FIG. 7A, a container 50 is fed into the apparatus in the direction shown by the arrow. The reforming tool 100 is connected to the mandrel 120 which is part of the upper half of the necker. The lower half 130 includes a flat surface 132 that is urged against the neck of the container 50. As well know to those of ordinary skill, the upper and lower portions of the necker 120,130 ride on rollers 122,132, which, in turn ride along a surface (not illustrated) in the manner of a cam and follower to displace these portions relative to one another and the container 50. Thus, as shown by FIG. 7B designated "Position #2," as the container 50 and its associated upper and lower necking portions 120,130 move through the necking machinery, the upper and lower portions close and initially seat the container 50 in the necker. The next step is the bottom reform, discussed above with reference to FIGS. 5A–5C. Finally, after reforming, the can is discharged, as seen in FIG. 7D, when the upper and lower portions of the necker 120, 130 move apart.

Although certain embodiments of the present invention have been set forth herein with particularity, they are not meant to limit the invention but to illustrate it. Those of ordinary skill will realize that a number of modifications may be readily made that do not depart from the spirit of this invention. Accordingly, reference should be made to the appended claims in order to ascertain the true scope of the present invention.

What is claimed:

1. Apparatus for high speed reforming a container having a domed bottom defining a bottom opening comprising:

a tool holder having a substantially flat base portion for receiving a support surface of the container, said base portion comprising a location in contact with the domed bottom of the container and a section extending in a horizontal plane outwardly therefrom, whereby the container bottom opening encounters no obstruction upon insertion into and removal from the tool holder;

a forming tool mounted in the tool holder and comprising a plurality of integral, radially expandable elements arrayed about a central axis; and a means inserted within the forming tool for displacing one or more of the elements outwardly and away from the central axis to deform a portion of the domed bottom of a container seated on the base portion.

2. The apparatus of claim 1 wherein the radially expandable elements comprise deforming portions having a arcuate deforming surface corresponding to a predetermined portion of the container to be deformed.

3. The apparatus of claim 2, wherein the arcuate deforming surfaces of the plurality of radially expandable elements form a substantially continuous circumferential surface prior to being expanded.

4. The apparatus of claim 1, wherein the radially expandable element has a round profile.

5. The apparatus of claim 1, wherein the radially expandable element has a square profile.

6. The apparatus of claim 1, wherein the radially expandable element has a substantially square profile having one chamfered edge.

7. The apparatus of claim 1, wherein the radially expandable element has a substantially square profile having two chamfered edges.

8. The apparatus of claim 1, wherein the means for displacing the radially expandable elements comprises a tapered mandrel.

9. A container necking mechanism comprising:

a necking push plate adjacent the bottom of a container; and apparatus for reforming a container having a domed bottom defining a bottom opening connected to the necking push plate comprising:

a tool holder having a substantially flat base portion for receiving a support surface of the container, said base portion comprising a location in contact with the domed bottom of the container and a section extending in a horizontal plane outwardly therefrom, whereby the container bottom opening encounters no obstruction upon insertion into and removal from the tool holder;

a forming tool mounted in the tool holder and comprising a plurality of radially expandable elements arrayed about a central axis; and a means inserted within the forming tool for displacing one or more of the elements outwardly and away from the central axis to deform a portion of the domed bottom of a container seated on the base portion.

10. The mechanism of claim 9, wherein the container necking mechanism is a die necker.

11. The mechanism of claim 9, wherein the container necking mechanism is a spin necker.

* * * * *